US010065422B2

(12) United States Patent
Nystrom

(10) Patent No.: US 10,065,422 B2
(45) **Date of Patent: *Sep. 4, 2018**

(54) PRINTHEAD WITH NARROW ASPECT RATIO

(71) Applicant: Xerox Corporation, Norwalk, CT (US)

(72) Inventor: Peter Johan Nystrom, Webster, NY (US)

(73) Assignee: XEROX CORPRORATION, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/409,709

(22) Filed: Jan. 19, 2017

(65) Prior Publication Data

US 2017/0129242 A1 May 11, 2017

Related U.S. Application Data

(63) Continuation of application No. 14/276,205, filed on May 13, 2014, now Pat. No. 9,550,358.

(51) Int. Cl.
*B41J 2/14* (2006.01)

(52) U.S. Cl.
CPC ..... *B41J 2/14233* (2013.01)

(58) Field of Classification Search
CPC ..... B41J 2/1433; B41J 2/145; B41J 2/14233; B41J 2002/14362
USPC ..... 347/20, 40
See application file for complete search history.

(56) References Cited

U.S. PATENT DOCUMENTS

| | | | | |
|---|---|---|---|---|
| 4,521,788 | A | 6/1985 | Kimura et al. | |
| 8,485,634 | B2 | 7/2013 | Mizes et al. | |
| 8,608,293 | B2 | 12/2013 | Redding et al. | |
| 9,550,358 | B2 * | 1/2017 | Nystrom | B41J 2/1433 |
| 2002/0080215 | A1 * | 6/2002 | Sakaida | B41J 2/14209 347/71 |
| 2005/0068379 | A1 | 3/2005 | Sanada | |
| 2013/0100212 | A1 | 4/2013 | Redding et al. | |
| 2013/0120505 | A1 | 5/2013 | Nystrom et al. | |
| 2013/0215197 | A1 | 8/2013 | Hays et al. | |

* cited by examiner

*Primary Examiner* — Jannelle M Lebron
(74) *Attorney, Agent, or Firm* — Fay Sharpe, LLP

(57) ABSTRACT

A printhead includes an aperture plate having an array of nozzles therethrough. The printhead further includes an array of jets fluidly connected to an ink supply chamber, each jet comprising a body chamber having a length:width ratio of at least 3:1. The body chamber comprises a first end, and a second end opposite the first end, the first end and the second end defining a height. Ink flows into body chamber through an inlet, and an outlet on the first end is fluidly connected to a nozzle. A diaphragm is present adjacent the second end of each body chamber in the array of jets. The body chambers are angled relative to a row of nozzles.

18 Claims, 5 Drawing Sheets

PRINTHEAD WITH NARROW ASPECT RATIO

CROSS-REFERENCE TO RELATED APPLICATIONS

This application is a continuation of U.S. patent application Ser. No. 14/276,205, filed May 13, 2014, now U.S. Pat. No. [insert later], which is incorporated herein by reference in its entirety.

BACKGROUND

This application generally relates to inkjet architectures for printing, and more particularly, printheads employing multiple components arranged in arrays. These printheads are suitable for thin film piezoelectric designs and electrostatic designs.

Ink jet systems include one or more printheads having a plurality of jets from which drops of fluid are ejected towards a recording medium. The jets of a printhead receive ink from an ink supply chamber or manifold in the printhead which, in turn, receives ink from a source, such as an ink reservoir or an ink cartridge. Each jet includes a body chamber having one end in fluid communication with the ink supply manifold. The other end of the body chamber connects to an orifice or nozzle for ejecting drops of ink. The nozzles of the jets can be formed in an aperture plate having openings corresponding to the nozzles of the jets. During operation, drop ejecting signals activate actuators in the jets to expel drops of fluid from the jet nozzles onto the recording medium. By selectively activating the actuators of the jets to eject drops as the recording medium and/or printhead assembly are moved relative to one another, the deposited drops can be precisely patterned to form particular text and graphic images on the recording medium Piezoelectric ink jet printheads typically include a flexible diaphragm and a piezoelectric transducer attached to the diaphragm. When a voltage is applied to the piezoelectric transducer, typically through electrical connection with an electrode electrically coupled to a voltage source, the piezoelectric transducer deforms, causing the diaphragm to flex which expels a quantity of ink from a body chamber through an outlet and nozzle. The flexing further draws ink into the body chamber from a main ink reservoir through an inlet to replace the expelled ink.

Electrostatic ink jet printheads typically include a flexible diaphragm and a conductor spaced on the opposite side of the flexible diaphragm, creating an actuator chamber there between. When a voltage is applied between the diaphragm and the conductor, the diaphragm flexes down toward the conductor under electrostatic attraction. The flexing draws ink into the body chamber from a main ink reservoir through an inlet. When the voltage signal is removed, the restoring force of the diaphragm membrane causes a quantity of ink to expel from a body chamber through an outlet and nozzle.

It would be desirable to produce new printhead designs that enhance the flexibility of the overall design.

SUMMARY OF THE DISCLOSURE

The present disclosure relates to inkjet printheads that have long narrow body chambers. Such body chambers have a narrow aspect ratio. This permits the diaphragm of each body chamber to be relatively thin while remaining robust and provides control over the vibrational modes of the diaphragm as well.

Disclosed in various embodiments are ink-jet printheads comprising: (a) an aperture plate having an array of nozzles therethrough, the array of nozzles being arranged in rows and columns; and (b) an array of jets fluidly connected to an ink supply chamber, each jet comprising: a body chamber having a length:width ratio of at least 3:1, a first end, and a second end opposite the first end, the first end and the second end defining a height; an inlet fluidly connecting the body chamber with the ink supply chamber; and an outlet on the first end fluidly connected to a nozzle on the aperture plate; and a diaphragm adjacent the second end of the body chamber; wherein the length of each body chamber forms an angle with a row of nozzles, the angle being at least 10 degrees.

The angle formed by the length of each body chamber with the row of nozzles may be at least 45 degrees, and may also be less than 90 degrees.

The spacing between adjacent nozzles is generally greater than 200 μm, and may also be less than 1000 μm.

The printhead can be formed by bonding a stack of flat, patterned materials.

Each diaphragm may be deflected by a piezoelectric material contacting one side of the diaphragm. The piezoelectric material may be between 0.5 μm and 5 μm in thickness.

Alternatively, a conductive trace may be positioned opposite to each diaphragm, with a voltage being applied to the conductive trace to induce an electrostatic force that causes deflection in the diaphragm.

In some embodiments, a lower face of each body chamber is a rectangle of 4 sides with two sides of equal length and two sides of equal width.

In other embodiments, a lower face of each body chamber is a quadrilateral with 4 sides of equal length, two equal interior angles greater than 90 degrees, and two equal interior angles less than 90 degrees.

In yet other embodiments, a lower face of each body chamber is a quadrilateral.

In particular embodiments, in each jet, the inlet is spaced apart from the outlet in the body chamber. In others, the inlet concentrically surrounds the outlet on the first end of the body chamber.

In more specific embodiments, the body chamber has a length:width ratio of at least 10:1, or at least 15:1.

In various embodiments described herein, the aperture plate is rectangular, having a long edge and a short edge; the rows of the array of nozzles are parallel to the long edge; and the columns of the array of nozzles are angled with respect to the long edge.

An ink supply chamber can be connected to a plurality of inlets by a single ink feed.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
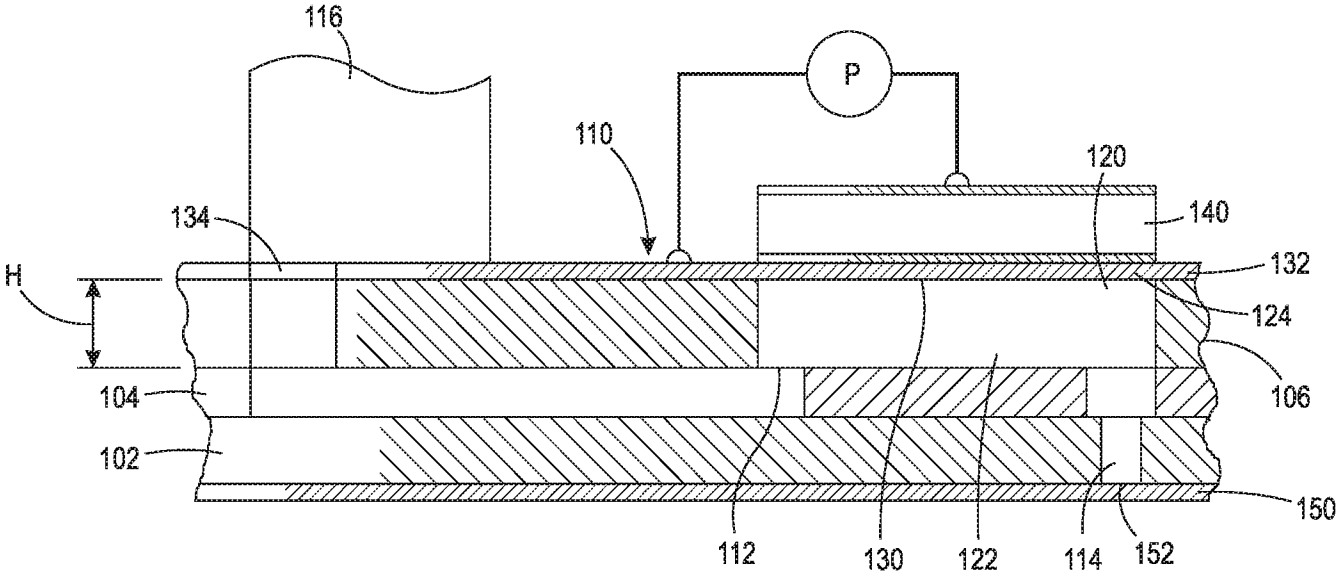
FIG. 1 is a cross-sectional side view of an exemplary embodiment of a piezoelectric ink jet printhead of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

Numerical values should be understood to include numerical values which are the same when reduced to the same number of significant figures and numerical values which differ from the stated value by less than the experimental error of the conventional measurement technique used to determine the value.

The modifier "about" used in connection with a quantity is inclusive of the stated value and has the meaning dictated by the context. When used in the context of a range, the modifier "about" should also be considered as disclosing the range defined by the absolute values of the two endpoints. For example, the range of "from about 2 to about 10" also discloses the range "from 2 to 10."

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that require the presence of the named component and permit the presence of other components. However, such description should be construed as also describing the devices and parts as "consisting of" and "consisting essentially of" the enumerated components, which allows the presence of only the named component, along with any impurities that might result from the manufacture of the named component, and excludes other components.

As used herein, the word "printer" encompasses any apparatus that performs a print outputting function for any purpose, such as a digital copier, bookmaking machine, facsimile machine, multi-function machine, or the like. Devices of this type can also be used in bioassays, masking for lithography, printing electronic components such as printed organic electronics, and making 3D models among other applications.

The word "ink" can refer to wax-based inks or gel-based inks known in the art and can also refer to any fluid that can be driven from the jets, including water-based solutions, solvents and solvent-based solutions, or UV-curable polymers, as well as mixtures thereof.

The word "metal" encompasses single metallic elements, including those such as copper, aluminum, titanium, or the like, or metallic alloys, including those such as stainless steel alloys, aluminum-manganese alloys, or the like, as well as mixtures thereof.

A "transducer" as used herein is a component that reacts to an electrical signal by generating a moving force that acts on an adjacent surface or substance. The moving force may push against or retract from the adjacent surface or substance.

The term "aspect ratio" as used herein refers to the length to width ratio of a body chamber. The length will always be equal to or greater than the width. For a quadrilateral, the length and width are determined by identifying the minimum rectangle that will enclose the body chamber.

Current design practices for ink jet printheads use generally square body chambers with thick diaphragms on the order of 20 micrometers (μm) or thicker. The present disclosure relates to a printhead design that permits the use of diaphragms that are much thinner, on the order of 15 μm or less, 10 μm or less, or preferably 5 μm or less. This is accomplished by the use of body chambers in the printhead that have a narrow aspect ratio (i.e. long and thin). This insures robustness of the diaphragm and permits better control of vibrational modes of the diaphragm. In addition, this architecture provides additional space for all of the requisite structures needed for a printhead, such as ink feed structures and electrical interconnects, while permitting the nozzles (i.e. jets) to be arranged in a multi-row and column layout. In other words, there is more design freedom for the printheads.

Another advantage of a multi-row and column jet layout is that this further reduces printhead sensitivity to print head roll. "Print head roll" refers to clockwise or counterclockwise rotation of a printhead about an axis normal to the image receiving surface, i.e., Z-axis. Print head roll misalignment may result from factors such as mechanical vibrations, and other sources of disturbances on the machine components, that may alter printhead positions and/or angles with respect to an image receiving surface. As a result of this misalignment, horizontal lines, image edges, and the like become skewed and appear as visual defects on the image receiving surface (e.g. paper) when the jets/nozzles of the printhead are widely separated from each other. When the jets/nozzles are relatively close to each other, such defects can be masked by being distributed over many rows. The narrow aspect ratio body chambers of the present disclosure permit the nozzles to be placed more closely together, increasing the density of nozzles on the printhead.

FIG. 1 is a side cross-sectional view of a single ink jet that can be used in the printhead of the present disclosure (the X-Z plane). This jet is a piezoelectric ink jet (PIJ). The jet body 110 is coupled to an ink supply chamber 116 of the printhead, which delivers ink to multiple ink jet bodies. The jet includes a hollow body chamber 120 that has a first end 122 and a second end 124. The first end and the second end are on opposite ends of the body chamber in the Z-axis, and define a height H. An inlet 112 fluidly connects the body chamber 120 to the ink supply chamber 116.

As depicted here, the inlet 112 is present on the first end 122 of the body chamber. An outlet 114 is also present at the first end 122 of the body chamber. Here, the inlet 112 and outlet 114 of body chamber 120 are spaced apart from each other. However, in other particular embodiments it is contemplated that the inlet concentrically surrounds the outlet on the first end of the body chamber.

A diaphragm 130 is present at the second end 124 of the body chamber. Each jet may have its own diaphragm, or a single diaphragm may be shared between jets. The diaphragm may be formed from silicon or another thin film material (e.g. nitride, oxide, etc.), a metal, ceramic, glass, or plastic sheet. The diaphragm has a thickness (in the Z-axis) of from 0.5 μm to 20 μm, including from 0.5 μm to 5 μm, or from 1 μm to about 3 μm. The diaphragm should be thin enough to flex easily, but also resilient enough to return to its original shape after it has been deformed.

A piezoelectric material 140 (e.g. a piezoelectric transducer) is secured to the diaphragm 130 by any suitable technique, and overlays the second end of body chamber 124. The thin film piezoelectric material 140 has a thickness (Z-axis) from 0.5 μm to 50 μm in thickness, including from 0.5 μm to 20 μm, from 0.5 μm to 15 μm, or from 0.5 μm to 5 μm, or from 1 μm to 20 μm, or from 1 μm to 10 μm. Desirably, the piezoelectric material is lead-free, i.e. does not contain lead (Pb). Each body chamber may have its own piezoelectric material, or a common piezoelectric film may be shared between body chambers. The piezoelectric material 140 can be bonded to, or deposited/grown directly on, the diaphragm 130 so that when the material deforms, the diaphragm deforms in the same direction. Each body chamber has separate electrodes 142, which are used for deforming the piezoelectric material.

The printhead also includes an aperture plate 150, which is adjacent the first end of the body chamber 120. The aperture plate includes a plurality of nozzles 152 which run from one side of the plate through to the other side of the plate. The outlet 114 of the body chamber 120 is fluidly connected to a nozzle 152 on the aperture plate. The aperture plate 150 has an aperture for each ink jet 110. In other words, there is a 1:1 correspondence of nozzles 152 to jet bodies 110 in the ink jet printhead.

Ink can flow from the ink supply chamber 116 in a continuous path through the jet body 110, starting at the inlet 112, into the body chamber 120, and then out through the outlet 114 and leaving through nozzle 152.

Ejection of an ink droplet is commenced with a firing signal. The firing signal occurs when a voltage or current (indicated by power source P) is applied across piezoelectric material 140 to excite the piezoelectric material, which causes the piezoelectric material to bend. Upon actuation of the piezoelectric material, the diaphragm 130 deforms to force ink from the body chamber 120 through the outlet 114 and nozzle 152. The expelled ink forms a drop of ink that lands onto an image receiving member, such as a paper substrate or an intermediate transfer member (not shown). Refill of body chamber 120 following the ejection of an ink drop is augmented by reverse bending of piezoelectric material 140 and the concomitant movement of diaphragm 130 that draws ink from the supply chamber 116 into body chamber 120. Alternatively, ink is drawn into the body chamber upon actuation through the deformation of the diaphragm, and expelled by the reverse bending of the piezoelectric material.

To facilitate manufacture of an ink jet printhead, an array of ink jets can be formed from multiple flat patterned plates. These plates are configured with a plurality of inlets, outlets, body chambers, and apertures, and then stacked in a superimposed relationship. For example, referring to FIG. 1, the aperture plate 150 provides exterior nozzles. The outlets of each body chamber can be provided by an outlet plate 102. The inlets are provided by an inlet plate 104. The body chamber itself is provided by a body plate 106. A diaphragm plate 132 provides the diaphragm, and includes ports 134 through which the ink supply chamber can be connected. The plates can then be bonded to each other via brazing or polymers/adhesives.

Figure 2:
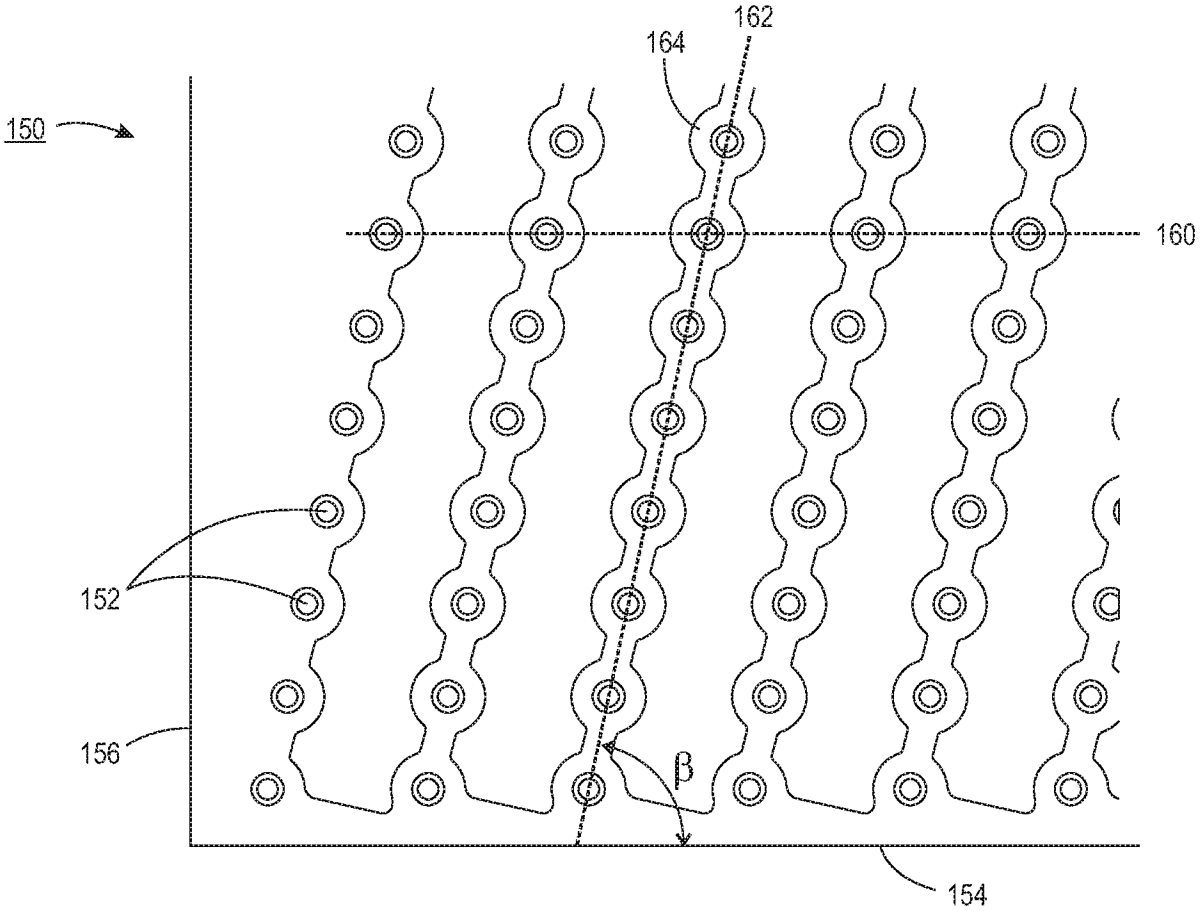
FIG. 2 is an exterior plan view of the aperture plate of the printhead of FIG. 1.

FIG. 2 is an exterior plan view of a corner portion of the aperture plate 150. As previously mentioned, the aperture plate has an array of nozzles 152. The nozzles are desirably spaced at least 200 μm apart from any adjacent nozzle, and less than 1000 μm from any adjacent nozzle. In more particular embodiments, the nozzles are spaced at least 250 μm apart, or at least 280 μm apart, and are still less than 1000 μm from any adjacent nozzle. As printhead densities increase, the area available to provide for electrical interconnects and fluid paths decreases and subsequently tighter tolerances are required. As such, maintaining this spacing between adjacent nozzles allows for easier tolerances during assembly of ink jet printheads without sacrificing ink jet density.

The nozzles 152 are arranged in rows 160 and columns 162. In this regard, the aperture plate 150 is rectangular, having a long edge 154 and a short edge 156. As illustrated here, the rows 160 of nozzles are parallel to the long edge 154. The columns 162 are angled with respect to the long edge 154, as indicated by angle β. This angle is always measured relative to the long edge 154, and will always be 90 degrees or less. Here, the angle β is roughly 75°.

FIG. 2 illustrates an embodiment where the inlet of each body chamber concentrically surrounds the outlet. As illustrated here, a single ink feed 164 runs down a column 162 of nozzles and is connected to a plurality of inlets (not visible). The nozzles 152 are visible, and correspond to the outlet of each body chamber. It is noted that the depiction of this single ink feed is merely representational, and the actual structure differs significantly.

Figure 3:
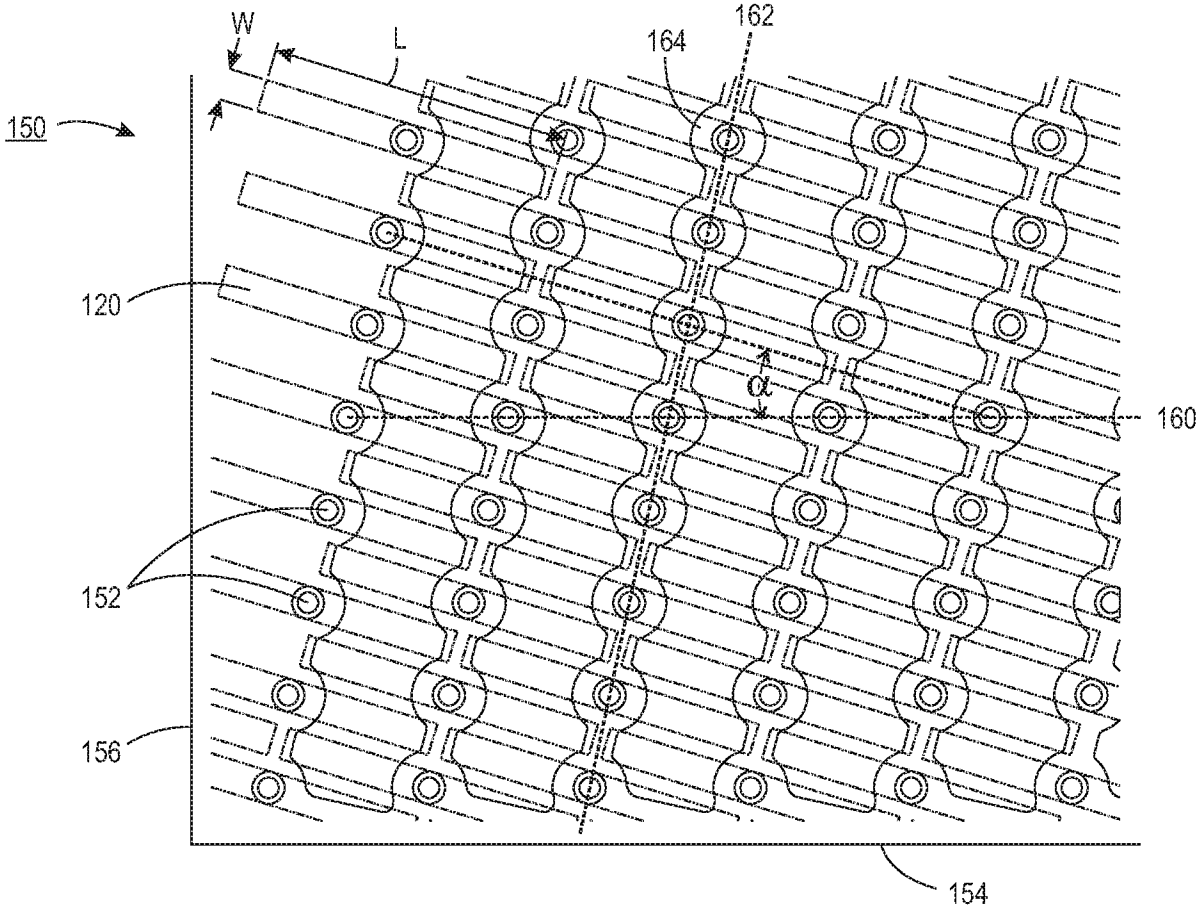
FIG. 3 is a plan view of one embodiment, showing an aperture plate with nozzles, and rectangular body chambers overlaying the nozzles to show their placement.

FIG. 3 is a view of a portion of the aperture plate 150, but now showing the positioning of the body chambers 120 as well. Each body chamber 120 is connected to an individual nozzle 152. As illustrated here, the lower face of each body chamber has a rectangular shape, i.e. has four sides with two sides of equal length (L) and two sides of equal width (W), wherein the length of the body chamber is greater than the width and all interior angles are at 90 degrees. Each body chamber also has a narrow aspect ratio. Each body chamber has a length L and a width W, and the length:width ratio (L:W) is at least 3:1. In more particular embodiments, the L:W ratio is at least 10:1, or at least 15:1. Generally, the L:W ratio does not exceed 20:1. This shape permits each body chamber to be relatively long and thin, while still enabling a multi-row layout for the nozzles.

The body chambers 120 are positioned relative to each other in a staggered fashion, with the lengths of the body chambers being arranged parallel to each other. The length L of each body chamber forms an angle relative to a row 160 of nozzles, this angle being indicated as α. The angle α is at least 10 degrees. In more particular embodiments, the angle α is at least 45 degrees. The angle α will not exceed 90 degrees.

The layout of body chambers as shown in FIG. 3 allows for an alignment of the ink jet printhead which is less sensitive to printhead roll. Alignment of the printhead within an ink jet printing system including a single printhead may be expressed as the position of the printhead relative to the image receiving surface. Alignment of multiple printheads in ink jet printing systems including multiple printheads may be expressed as the position of one printhead relative to the image receiving surface, such as a media substrate or intermediate transfer surface, or another printhead within a coordinate system of multiple axes. For purposes of discussion, the terms "cross-process direction" and "X-axis direction" refer to a direction or axis perpendicular to the direction of travel of an image receiving surface past a printhead. The terms "process direction" and "Y-axis direction" refer to a direction or axis parallel to the direction of travel of the image receiving surface. The term "Z-axis" refers to an axis perpendicular to the X-Y plane. The view shown in FIG. 3 is of the X-Y plane, and the shape of the body chamber is discussed viewing the body chamber from the X-Y plane of the aperture plate. Put another way, it should be recognized that the body chamber has three dimensions (i.e. a prism), and that the shape of the body chamber being referred to by the term "rectangular" refers to the lower face of the body chamber, when viewed in the X-Y plane.

Traditional layouts of body chambers and printheads have widely separated jets in the Y-axis direction. If the printhead becomes misaligned from factors such as mechanical vibrations, the widely separated Y-axis jets may exhibit visual defects on the image receiving member. The layout embodied in FIG. 3 distributes the visual defects over many rows and columns, masking the defects. Spreading the jets over many rows and columns also allows for ink feeds to be distributed more evenly. This allows for more design freedom in fluid paths and electrical interconnects.

Figure 4:
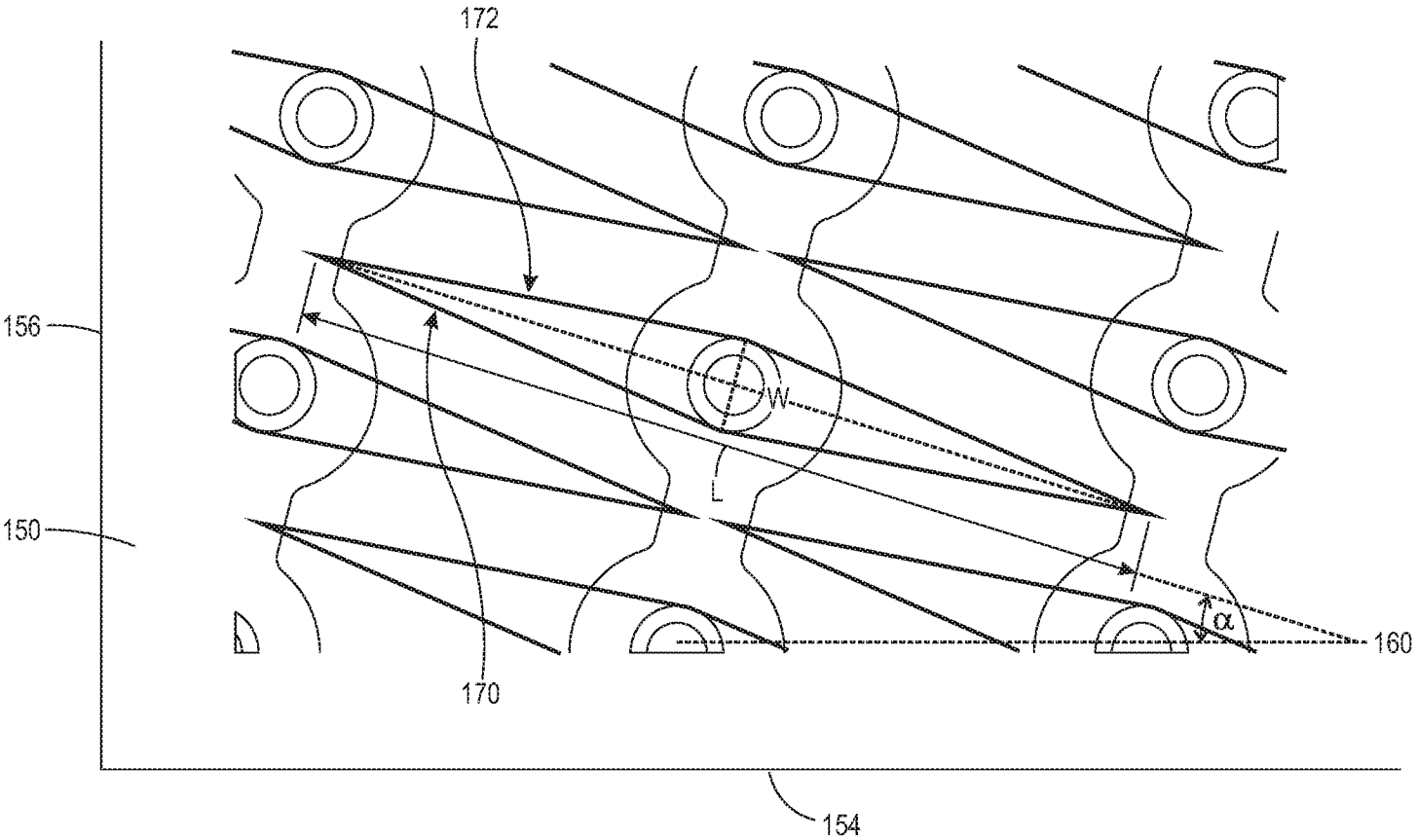
FIG. 4 is a plan view of another embodiment, showing an aperture plate with nozzles, and diamond-shaped body chambers overlaying the nozzles to show their placement.

Another embodiment of a body chamber layout contemplated by the present disclosure is shown in FIG. 4. Again, the aperture plate 150 is rectangular, having a long edge 154 and a short edge 156. Here, the lower faces of the body chambers 170 are diamond-shaped. That is, body chamber 170 is a quadrilateral with four sides 172 of equal length, two equal interior angles greater than 90 degrees, and two equal interior angles less than 90 degrees. The length and width are measured as the length of the sides of the minimum enclosing rectangle. The length (L) is the longer of the two lines, with the width (W) being the shorter. Again, the length L is oriented at angle $\alpha$ relative to a row 160 of nozzles. As previously described, the angle $\alpha$ is at least 10 degrees, and will not exceed 90 degrees.

More generally, the body chamber of the printheads can be of any shape when viewed in the X-Y plane, as long as the body chamber has a L:W ratio that is at least 3:1, or at least 10:1, or at least 15:1, and generally does not exceed 20:1. For example, the body chamber can be a parallelogram, or a trapezoid, or a diamond, or an ellipse. In more particular embodiments, the body chamber has a quadrilateral, i.e. has four sides. As previously described, the length (L) and width (W) are measured as the lengths of the minimum enclosing rectangle, with the length having the larger value. For an ellipse, the length and width will correspond to the major and minor axes.

Figure 5:
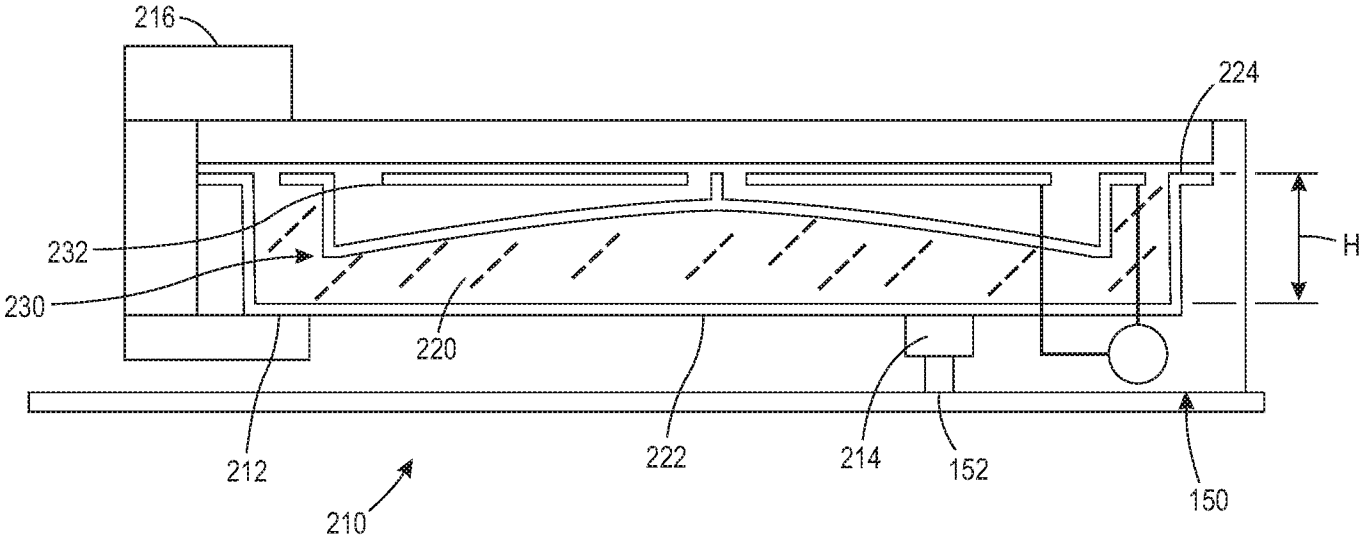
FIG. 5 is a cross-sectional side view of an exemplary embodiment of an electrostatic inkjet printhead of the present disclosure.

The printheads of the present disclosure, having a body chamber with a narrow aspect ratio, have been described above with reference to a piezoelectric ink jet. However, they are also applicable to electrostatic ink jets. FIG. 5 is a side cross-sectional view of an electrostatic ink jet 210. This electrostatic ink jet also includes a body chamber 220, an inlet 212 connecting to an ink supply chamber 216, and an outlet 214 connected to a nozzle 152 in an aperture plate 150. The body chamber 220 has a first end 222 adjacent the aperture plate, and also has a second end 224 spaced apart from the first end that defines a height H of the body chamber. The second end includes a diaphragm 230 and a conductive trace 232, with the diaphragm being located between the conductive trace and the outlet.

Ejection of an ink droplet is commenced with the firing signal being applied by power source P across the conductive trace 232, which is typically a metal or semiconductor film such as polysilicon. This creates an electrostatic attraction that deflects diaphragm 230 towards conductive trace 232. Ink is pulled into the body chamber 220 by the deflection of diaphragm 230. When the bias voltage or charge is eliminated, diaphragm 230 relaxes, increasing pressure in body chamber 220. As the pressure increases, ink is expelled out of outlet 214 and nozzle 152, creating a drop of ink that lands onto an image receiving member (not shown).

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. An ink-jet printhead comprising:

(a) an aperture plate having an array of nozzles therethrough, the array of nozzles being arranged in evenly spaced rows and columns; and (b) an array of jets fluidly connected to an ink supply chamber, each jet comprising:

a body chamber having a length:width ratio of at least 3:1, a first end, and a second end opposite the first end, the first end and the second end defining a height;

an inlet fluidly connecting the body chamber with the ink supply chamber; and an outlet on the first end fluidly connected to a nozzle on the aperture plate; and a diaphragm adjacent the second end of the body chamber;

wherein the length of each body chamber forms an angle with a row of nozzles, the angle being at least 10 degrees and less than 90 degrees, with respect to an exterior plan view of the aperture plate.

2. The printhead of claim 1, where the angle is at least 45 degrees.

3. The printhead of claim 1, wherein the spacing between adjacent nozzles is greater than 200 μm.

4. The printhead of claim 1, wherein the spacing between adjacent nozzles is less than 1000 μm.

5. The printhead of claim 1, where the printhead is formed by bonding a stack of flat, patterned materials.

6. The printhead of claim 1, wherein each diaphragm is deflected by a piezoelectric material contacting one side of the diaphragm.

7. The printhead of claim 6, wherein the piezoelectric material is from 0.5 μm to 50 μm in thickness.

8. The printhead of claim 1, in which a conductive trace is positioned opposite to each diaphragm and a voltage is applied to the conductive trace to induce an electrostatic force that causes deflection in the diaphragm.

9. The printhead of claim 1, in which a lower face of each body chamber is a rectangle of 4 sides with two sides of equal length and two sides of equal width.

10. The printhead of claim 1, in which a lower face of each body chamber is a quadrilateral with 4 sides of equal length, two equal interior angles greater than 90 degrees, and two equal interior angles less than 90 degrees.

11. The printhead of claim 1, in which a lower face of each body chamber is a quadrilateral.

12. The printhead of claim 1, wherein in each jet, the inlet is spaced apart from the outlet in the body chamber.

13. The printhead of claim 1, wherein in each jet, the inlet concentrically surrounds the outlet on the first end of the body chamber.

14. The printhead of claim 1, in which the body chamber has a length:width ratio of at least 10:1.

15. The printhead of claim 1, in which the body chamber has a length:width ratio of at least 15:1.

16. The printhead of claim 1, wherein the aperture plate is rectangular, having a long edge and a short edge; the rows of the array of nozzles are parallel to the long edge; and the columns of the array of nozzles are angled with respect to the long edge.

17. The printhead of claim 1, wherein the ink supply chamber is connected to a plurality of inlets by a single ink feed.

18. The printhead of claim 1, wherein each diaphragm is from 0.5 μm to 20 μm in thickness.

* * * * *